United States Patent [19]

Echterling

[11] 3,960,316

[45] June 1, 1976

[54] NEWSPAPER ARRIVAL INDICATORS

[76] Inventor: Hubert H. Echterling, 12802 W. 129th Ave., Cedar Lake, Ind. 46303

[22] Filed: Apr. 12, 1974

[21] Appl. No.: 460,491

[52] U.S. Cl. ..... 232/1 C; 116/132 R; 232/35

[51] Int. Cl.[2] ..... B65D 91/00

[58] Field of Search ..... 116/135, 134, 132 R; 49/344; 232/35, 1 C

[56] References Cited

UNITED STATES PATENTS

| | | | |
|---|---|---|---|
| 2,581,880 | 1/1952 | Price | 232/35 |
| 2,613,031 | 10/1952 | Joyce | 116/132 X |
| 2,808,982 | 10/1957 | Armstrong | 116/135 X |
| 3,144,984 | 8/1964 | Ross | 232/1 C |
| 3,275,228 | 9/1966 | Golla | 232/1 C |

*Primary Examiner*—Richard C. Queisser
*Assistant Examiner*—Daniel M. Yasich

[57] ABSTRACT

A visual indicator for boxes in which printed matter — such as newspapers or periodicals — are delivered. An indicator flag is normally concealed underneath the box, and drops to a visible position when a plate in the front of the box is impinged by the insertion of the printed matter. The flag and the plate have a latching relation to re-set the indicator after the box contents have been removed.

1 Claim, 3 Drawing Figures

NEWSPAPER ARRIVAL INDICATORS

This invention relates to boxes in which printed materials — such as newspapers, periodicals and the like — are inserted by messengers or mail carriers, and more particularly to indicators which emerge from a concealed position when such a delivery is made. The boxes provided for this purpose are usually made of sheet material, such as metal or plastic; and one object of the present invention is to provide an indicator which is readily attachable to any conventional box without the need of skill or tools.

Boxes of the type under consideration usually have a rounded top and flat bottom; and a further object is to provide an indicator which is entirely underneath the top of the box for shelter from inclement weather, but attached only to the bottom of the box.

Another object is to provide an indicator which requires no alterations or perforations in the body portion of the box, so that no joints or crevices occur in the same for rain to enter and cause corrosion.

A still further object is to construct the indicator without springs or other delicate parts which might get out of order and impair the use of the indicator.

An additional object is to include a frontal member in the box actuated by the insertion of the printed material to operate the indicator, such member yielding to material of any thickness or level and presenting no interference to the removal of printed material from the box.

A final object is to design the indicator with parts which are few and simple for quick installation.

Figure 1:
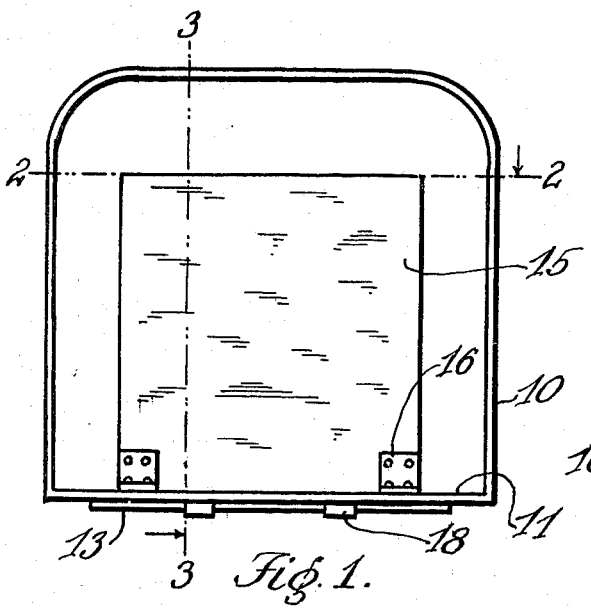
Figure 2:
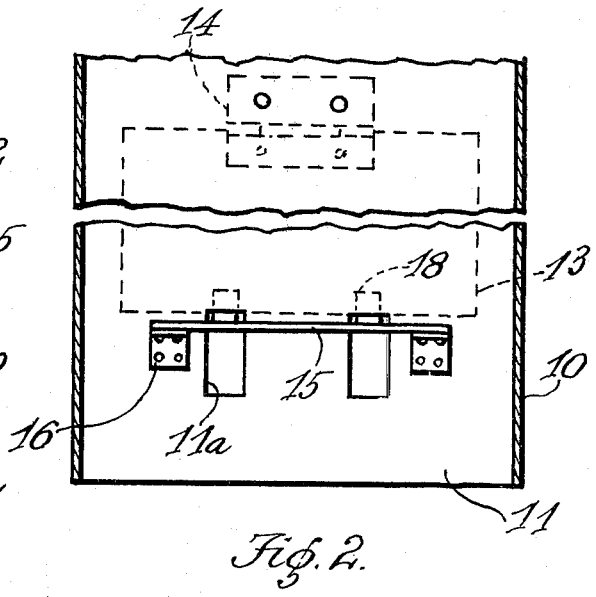
Figure 3:
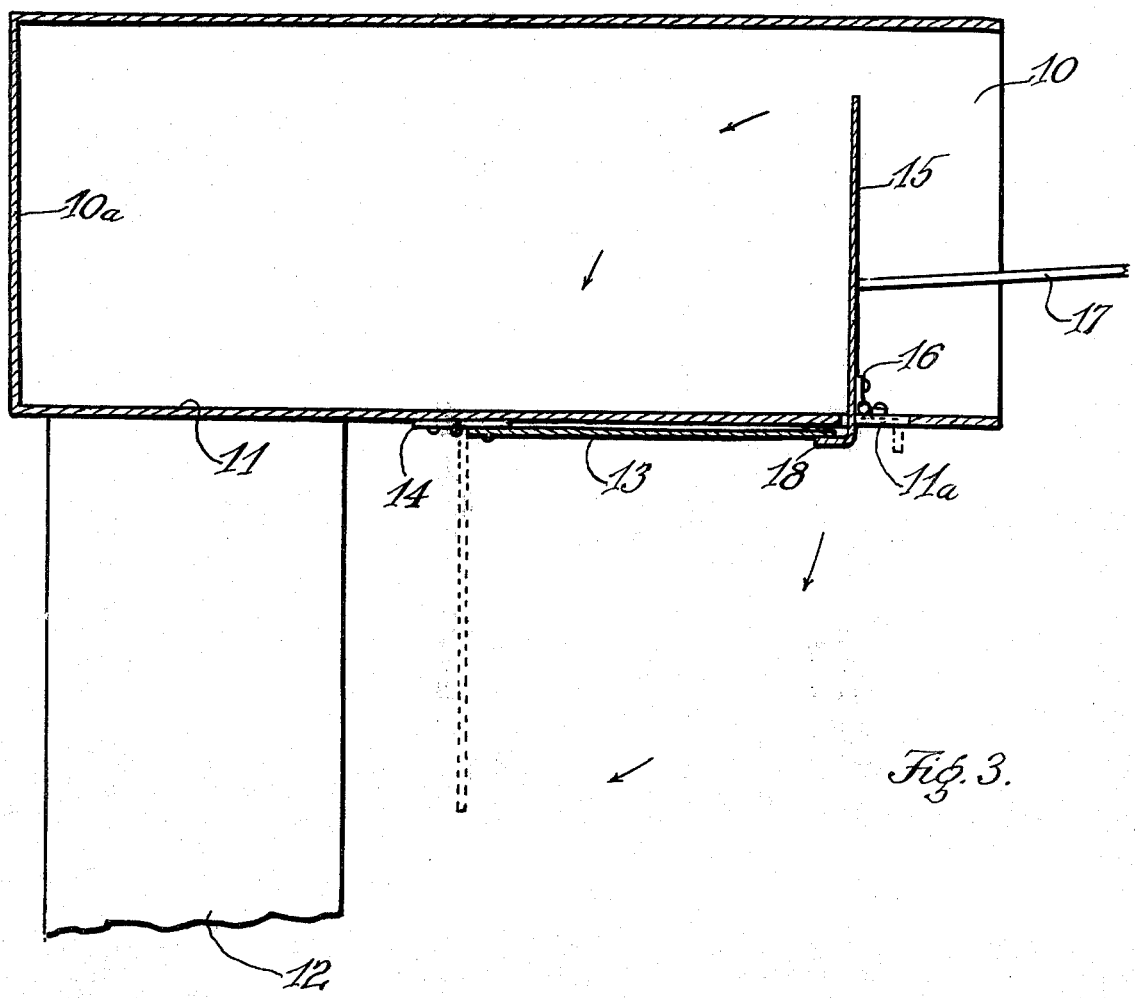

A better understanding of the invention may be gained by reference to the accompanying drawing, in which FIG. 1 is a front elevation of the box with the indicator installed and before any printed materials - such as newspapers or periodicals - are inserted therein;

FIG. 2 is a section on the line 2—2 of FIG. 1, with the rear portion of the box broken away; and FIG. 3 is a section on the line 3—3 of FIG. 1.

Referring specifically to the drawing, 10 denotes the box and 11 its bottom. The rear end of the box is closed, as indicated at 10*a;* and the box is usually mounted on a post 12. The indicator itself — usually called a flag — is a plate 13 which normally occupies a horizontal position next underneath the bottom 11; and the plate is attached at the rear to the bottom by a medial hinge 14 — or by two hinges spaced apart, if desired — so that it may swing down in the direction of the arrows in the lower part of FIG. 3 to the pendent position indicated by finely-dotted lines.

An upstanding plate 15 is positioned crosswise within the front of the box 10, and is attached by hinges 16 to the bottom 11 of the box. The plate is therefore in the inserting path of the printed matter — such as a pamphlet 17 — and yields in the direction of the arrows in the upper part of FIG. 3 to a position of rest on the bottom of the box, where it remains underneath the pamphlet.

The plate 15 is extended in downward direction with a laterally-spaced pair of hooks 18. As seen in FIG. 3, these form supports — when the plate 15 is in the vertical position — for the forepart of the flag 13, so that it is not in view normally, that is, before any printed matter is inserted into the box. However, when this is done with impinging influence on the plate 15, the backswing thereof withdraws the hooks 18 to the position indicated by finely-dotted lines in FIG. 3. The flag 13 thus loses its frontal support, and swings down to the pendent position as a visible indicator that contents are present in the box.

Since the hooks 18 normally depend below the level of the box floor, the latter is cut with openings 11a for the passage of the hooks; and the openings are of sufficient length — as seen in FIG. 2 — to allow the hooks clearance to the dotted-line position of FIG. 3 on the backswing of the plate 15.

It is now apparent that the indicator is set with the plate 15 vertical previous to use, and that the flag 13 drops automatically to indicating position when printed matter is inserted into the box. After the removal of the box contents the plate 15 remains down. In order to return it to the upstanding position the flag 13 is first drawn forward to the horizontal position indicated by full lines in FIG. 3. The plate 15 is then raised to the vertical position. This returns the hooks 18 to positions supporting the forepart of the flag; and the release of the latter will cause it to bear on the hooks and maintain the plate 15 in the upright or re-set position.

With the mechanism designed and operable as described, it is apparent that the plate 15 serves both as an impact object for printed material being inserted into the box and as a latch supporting the flag 13 out of sight as long as printed material is not inserted. At the same time the flag bears by its weight on the hooks 18 to keep the plate 15 vertical. In addition, the weight of the flag is effective, when the hooks 18 are withdrawn, to quickly drop the flag to indicating position. The indicator therefore functions positively, and without the use of springs or other delicate parts which may get out of order.

It is proper to point out that an advantage is gained by hinging the plate 15 from the bottom instead of from the top. Thus, printed material of any thickness or at any height will impinge on the plate 15 when inserted. Also, the plate folds beneath the inserted material where it can present no obstacle to the removal of the same. Further, the installation of the indicator may be simplified by using a cement instead of the rivets or screws shown to attach the hinges to the plates and the box bottom. Finally, the indicator is suitable for sale as a kit with simple instructions for its installation in any conventional box of the character described.

I claim:

1. In a box-like receptacle having an open end for insertion of printed matter such as newspapers and other printed matter, an assembly to visually indicate the presence of such printed matter within said receptacle comprising movable visual indicator means held in an unseen position when said receptacle is empty and means within said receptacle which coacts with said indicator means and which is responsive to the insertion of said printed matter into said receptacle to cause said indicator means to move from said unseen position to a visible position; said indicator means comprising a gravity-movable, rectangular first plate having first pivotal means attached to one end thereof, said pivotal means being secured to the outer surface of the bottom of said receptacle with the axis of the pivotal means being perpendicular to the length of said receptacle and positioned on said outer surface a distance from said open end which is greater than the length of said first plate when said first plate is in said unseen position; said insertion responsive means comprising a rectangular second plate having second pivotal means to pivotally mount said second plate on the inner surface of said bottom in an upstanding position within, and cross-wise of, said receptacle adjacent the open end of said receptacle when same is empty, said pivotal means providing for rotational movement of said second plate only toward the interior of said receptacle to the inner surface of said bottom, at least one portion of said second plate extending through at least one opening in said bottom, the said at least one portion having its terminal edge formed as a rearwardly extending support means for the other end of said first plate in said unseen position when said second plate is in said upstanding position, the weight of said first plate acting on said support means to hold said second plate in said upstanding position when said receptacle is empty, the rearward rotational movement of said upstanding second plate upon the insertion of said printed matter against the portion of the second plate within said receptacle rotatably removing said support means from said other end of said first plate whereby the weight of said first plate rotates said first plate about its pivotal axis to a pendant visible position.

* * * * *